US007270519B2

(12) United States Patent
Wadia et al.

(10) Patent No.: US 7,270,519 B2
(45) Date of Patent: Sep. 18, 2007

(54) METHODS AND APPARATUS FOR REDUCING FLOW ACROSS COMPRESSOR AIRFOIL TIPS

(75) Inventors: Aspi R. Wadia, Loveland, OH (US); Rolf Hetico, Cincinnati, OH (US); Robert Bruce Dickman, Cincinnati, OH (US); Hsin-Yi Yen, Fairfield, OH (US); Peter Wood, Loveland, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/292,250

(22) Filed: Nov. 12, 2002

(65) Prior Publication Data

US 2004/0091361 A1 May 13, 2004

(51) Int. Cl.
*F01D 5/10* (2006.01)

(52) U.S. Cl. ..... 416/236 R; 416/235; 29/889.7

(58) Field of Classification Search ..... 416/228, 416/235, 236 R, 237, 189, 191, 192, 193 R, 416/236 A; 415/191, 208.1, 208.2, 173.1; 29/889.7

See application file for complete search history.

(56) References Cited

U.S. PATENT DOCUMENTS

| | | | | | |
|---|---|---|---|---|---|
| 1,424,672 | A * | 8/1922 | Ogrissek | ..... | 416/236 R |
| 2,265,788 | A * | 12/1941 | Wolf, Sr. et al. | ..... | 416/236 R |
| 2,965,180 | A * | 12/1960 | Killam | ..... | 416/236 R |
| 3,012,709 | A * | 12/1961 | Schnell | ..... | 416/236 R |
| 3,193,185 | A * | 7/1965 | Erwin et al. | ..... | 416/236 A |
| 3,706,512 | A * | 12/1972 | Strelshik | ..... | 416/236 R |
| 3,771,922 | A * | 11/1973 | Tracy | ..... | 416/191 |
| 4,108,573 | A * | 8/1978 | Wagner | ..... | 416/236 A |
| 4,589,824 | A | 5/1986 | Kozlin | | |
| 5,261,789 | A | 11/1993 | Butts et al. | | |
| 5,288,209 | A * | 2/1994 | Therrien et al. | ..... | 416/193 R |
| 6,164,914 | A | 12/2000 | Correia et al. | | |
| 6,179,556 | B1 | 1/2001 | Bunker | | |
| 6,318,961 | B1 * | 11/2001 | Phillipsen | ..... | 416/235 |
| 6,382,913 | B1 | 5/2002 | Lee et al. | | |
| 6,565,324 | B1 * | 5/2003 | Phillipsen et al. | ..... | 416/236 R |
| 6,572,332 | B2 * | 6/2003 | Harvey et al. | ..... | 415/191 |

FOREIGN PATENT DOCUMENTS

| | | | | | |
|---|---|---|---|---|---|
| DE | 1108-374 | A * | 6/1961 | ..... | 416/235 |
| DE | 2135287 | A * | 1/1973 | ..... | 416/236 A |
| GB | 840543 | A * | 7/1960 | ..... | 416/236 A |
| WO | WO 00/57029 | A1 * | 9/2000 | ..... | 416/236 R |

* cited by examiner

*Primary Examiner*—Edward K. Look
*Assistant Examiner*—Dwayne J White
(74) *Attorney, Agent, or Firm*—William Scott Andes Armstrong Teasdale LLP

(57) ABSTRACT

An airfoil for a gas turbine engine includes a leading edge, a trailing edge, a tip, a first side wall that extends in radial span between an airfoil root and the tip, wherein the first side wall defines a first side of said airfoil, and a second side wall connected to the first side wall at the leading edge and the trailing edge, wherein the second side wall extends in radial span between the airfoil root and the tip, such that the second side wall defines a second side of the airfoil. The airfoil also includes a rib extending outwardly from at least one of the first side wall and the second side wall, wherein the rib is configured to reduce airflow spillage past the tip.

12 Claims, 4 Drawing Sheets

METHODS AND APPARATUS FOR REDUCING FLOW ACROSS COMPRESSOR AIRFOIL TIPS

BACKGROUND OF THE INVENTION

This application relates generally to gas turbine engine rotor blades and, more particularly, to methods and apparatus for reducing tip spillage across a rotor blade tip.

Gas turbine engine rotor blades typically include airfoils having leading and trailing edges, a pressure side, and a suction side. The pressure and suction sides connect at the airfoil leading and trailing edges, and span radially between the airfoil root and the tip. An inner flowpath is defined at least partially by the airfoil root, and an outer flowpath is defined at least partially by a stationary casing. More specifically, the stationary casing is positioned radially outwardly from the airfoil tips such that a gap is defined between the shroud and the airfoil tips.

For example, such blades are used in at least some known compressors, and during compressor assembly, the gap defined between the shroud and airfoil tips is sized to permit differential growth of the rotating airfoil tips and the stationary casing throughout compressor operation. More specifically, during engine operation, the gap may increase due to airfoil tip erosion or manuever loading. Over time, continued operation of the compressor with the increased gap may cause tip to casing flow interference. Furthermore, as a result of the inherent pressure differential created on opposite sides of the operating blade, an increased gap may permit air to undesirably flow across the airfoil tip from the pressure side of the airfoil to the suction side of the airfoil. Such undesirable air flow is known as parasitic flow or tip spillage and may adversely affect the operating efficiency of the compressor.

To facilitate reducing tip spillage, at least some known compressor rotating blades include a rotating tip shroud that is attached to the airfoil tip to facilitate minimizing the radial gap between the blade and the casing. Although the tip shroud also facilitates reducing tip spillage, the configuration may also introduce complex interfaces between adjacent airfoil tips, and increases an overall weight of the rotor structure. At least some other known compressor rotor blades employ winglets attached to the airfoil tip to facilitate inhibiting tip spillage. However, known winglet designs are limited in use because of the design challenges presented in attaching the winglets to the airfoils and in close proximity to the stationary case.

BRIEF SUMMARY OF THE INVENTION

In one aspect a method for fabricating a rotor blade for a gas turbine engine is provided. The method comprises forming an airfoil including a first side wall and a second side wall that each extend in radial span between an airfoil root and an airfoil tip, and wherein the first and second side walls are connected at a leading edge and at a trailing edge, and forming a rib that extends outwardly from at least one of the airfoil first side wall and the airfoil second side wall, such that the rib facilitates reducing airflow spillage past the airfoil tip.

In another aspect of the invention, an airfoil for a gas turbine engine is provided. The airfoil includes a leading edge, a trailing edge, a tip, a first side wall that extends in radial span between an airfoil root and the tip, wherein the first side wall defines a first side of said airfoil, and a second side wall connected to the first side wall at the leading edge and the trailing edge, wherein the second side wall extends in radial span between the airfoil root and the tip, such that the second side wall defines a second side of the airfoil. The airfoil also includes a rib extending outwardly from at least one of the first side wall and the second side wall, wherein the rib is configured to reduce airflow spillage past the tip.

In a further aspect, a gas turbine engine including a plurality of rotor blades is provided. Each rotor blade includes an airfoil having a leading edge, a trailing edge, a first side wall, a second side wall, and at least one rib. The airfoil first and second side walls are connected axially at the leading and trailing edges, and each side wall extends radially from a blade root to an airfoil tip. The rib extends outwardly from at least one of the airfoil first side wall and the airfoil second side wall. The first side wall defines a pressure side of the airfoil, and the second side wall defines a suction side of the airfoil. The rib facilitates reducing air flowing from the airfoil pressure side to the airfoil suction side past the airfoil tip.

DETAILED DESCRIPTION OF THE INVENTION

Figure 1:
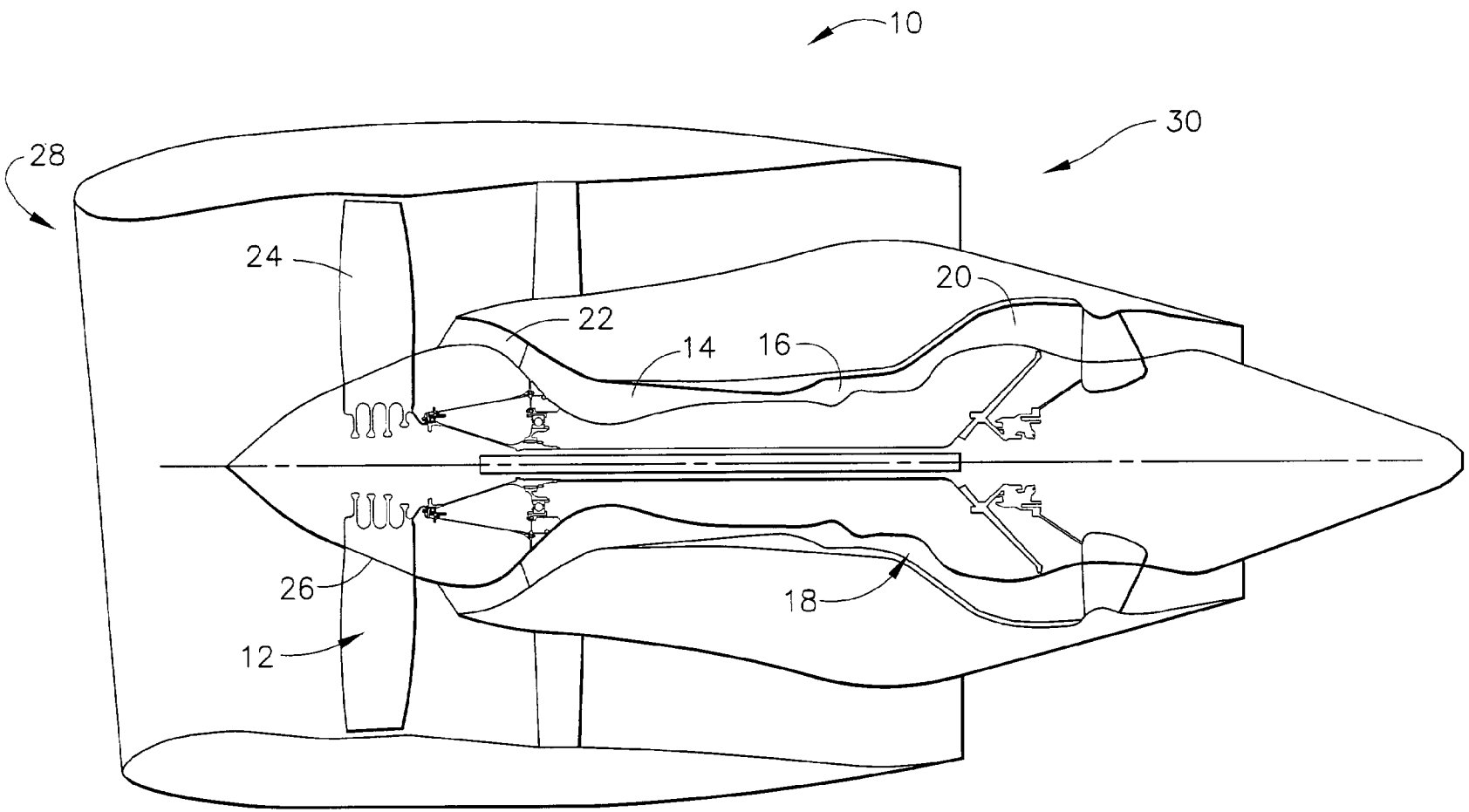
FIG. 1 is schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30. In one embodiment, the gas turbine engine is a GE90 available from General Electric Company, Cincinnati, Ohio.

In operation, air flows through fan assembly 12 and compressed air is supplied to high pressure compressor 14. The highly compressed air is delivered to combustor 16. Airflow (not shown in FIG. 1) from combustor 16 drives turbines 18 and 20, and turbine 20 drives fan assembly 12.

Figure 2:
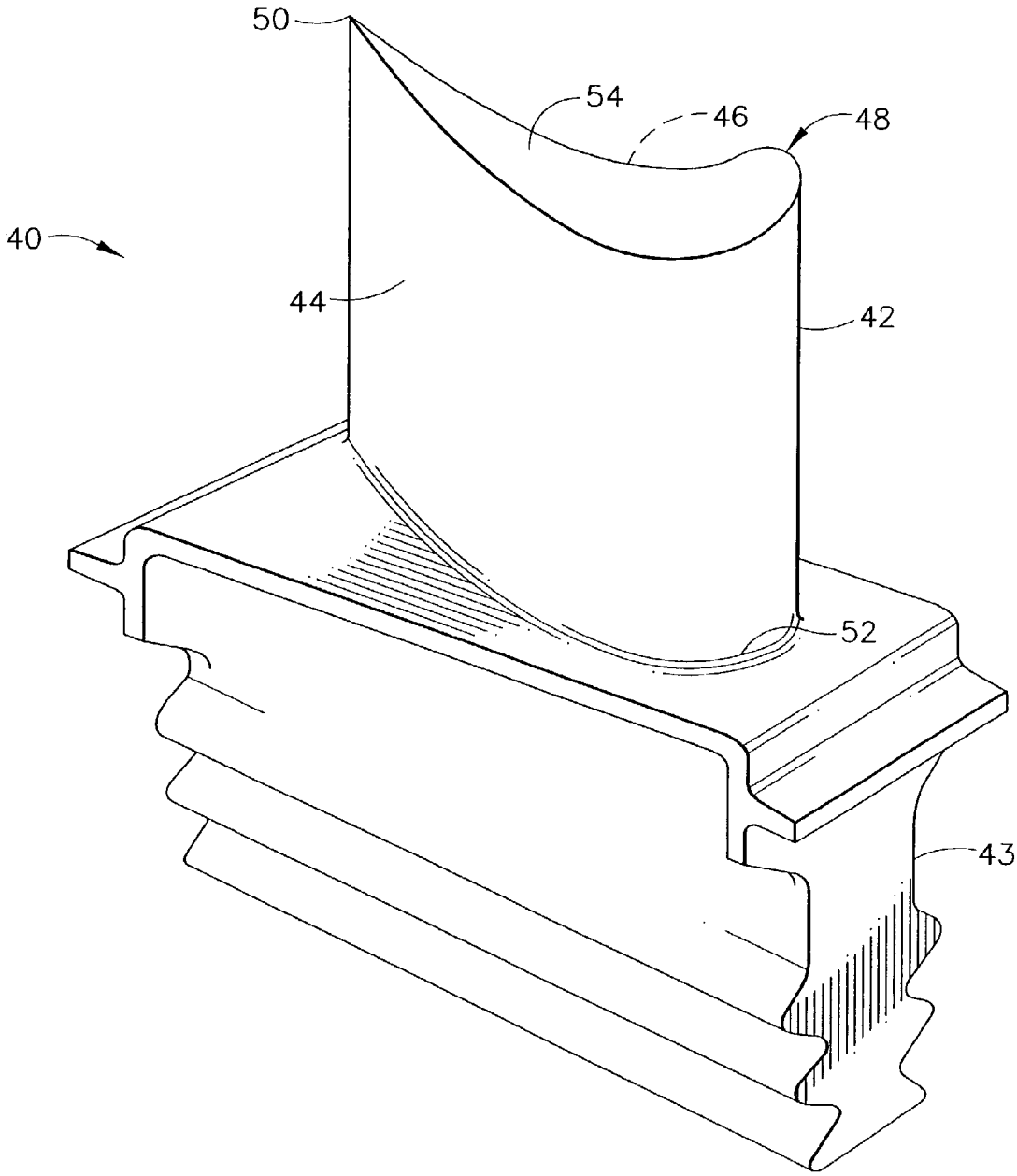
FIG. 2 is a perspective view of a rotor blade that may be used with the gas turbine engine shown in FIG. 1.
Figure 3:
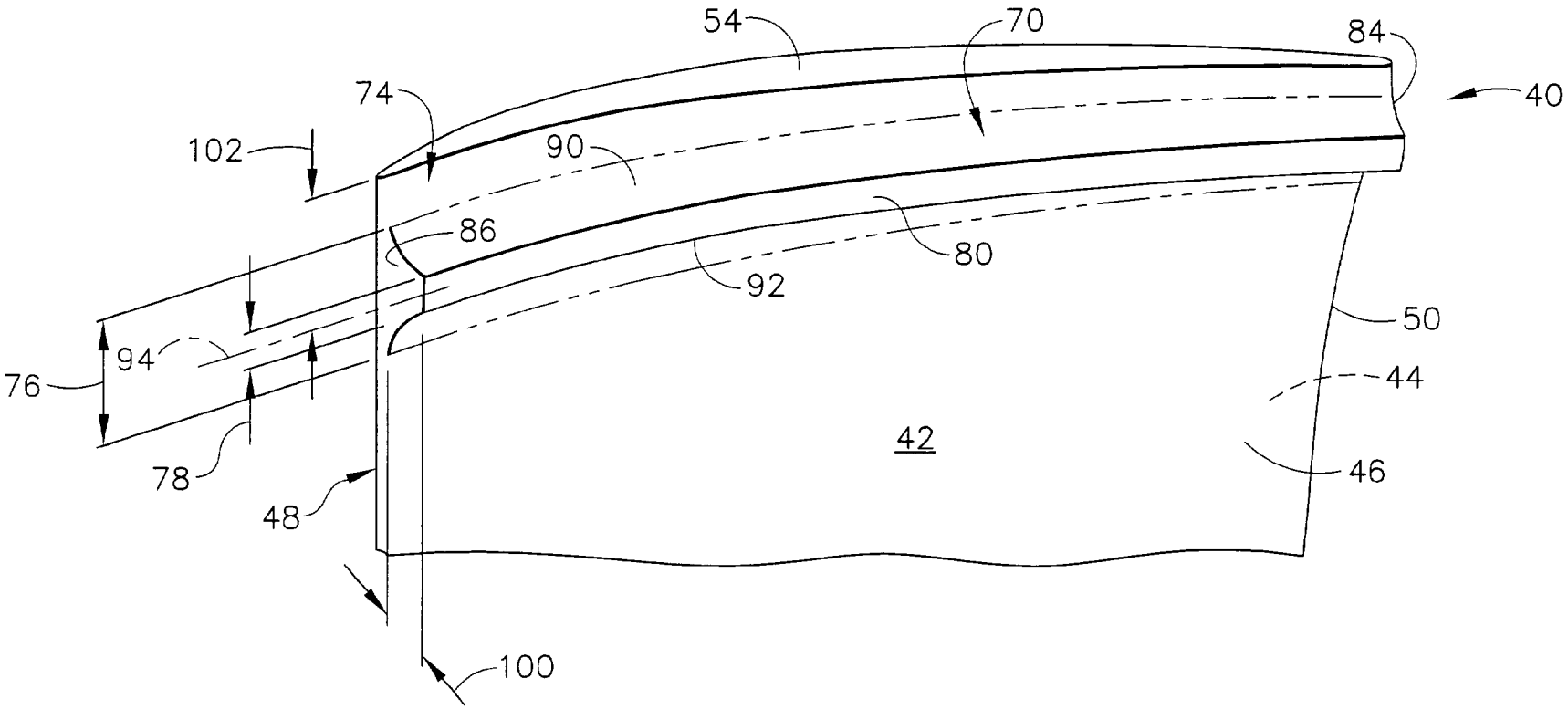
FIG. 3 is an enlarged partial perspective view of the rotor blade shown in FIG. 2, and viewed from an opposite side of the rotor blade.

FIG. 2 is a partial perspective view of a rotor blade 40 that may be used with a gas turbine engine, such as gas turbine engine 10 (shown in FIG. 1). FIG. 3 is an enlarged partial perspective view of the rotor blade shown in FIG. 2, and viewed from an opposite side of rotor blade 40. In one embodiment, a plurality of rotor blades 40 form a high pressure compressor stage (not shown) of gas turbine engine 10. Each rotor blade 40 includes an airfoil 42 and an integral dovetail 43 used for mounting airfoil 42 to a rotor disk (not shown) in a known manner. Alternatively, blades 40 may extend radially outwardly from a disk (not shown), such that a plurality of blades 40 form a blisk (not shown).

Each airfoil 42 includes a first contoured side wall 44 and a second contoured side wall 46. First side wall 44 is convex and defines a suction side of airfoil 42, and second side wall 46 is concave and defines a pressure side of airfoil 42. Side walls 44 and 46 are joined at a leading edge 48 and at an axially-spaced trailing edge 50 of airfoil 42. More specifically, airfoil trailing edge 50 is spaced chordwise and downstream from airfoil leading edge 48. First and second side walls 44 and 46, respectively, extend longitudinally or radially outward in span from a blade root 52 positioned adjacent dovetail 43, to an airfoil tip 54.

A rib 70 extends outwardly from second side wall 46. In an alternative embodiment rib 70 extends outwardly from first side wall 44. In a further alternative embodiment, a first rib 70 extends outwardly from second side wall 46 and a second rib 70 extends outwardly from first side wall 44. Accordingly, rib 70 is contoured to conform to side wall 46 and as such follows airflow streamlines extending across side wall 46. In the exemplary embodiment, rib 70 extends in a chordwise direction across side wall 46. Alternatively, rib 70 is aligned in a non-chordwise direction with respect to side wall 46. More specifically, in the exemplary embodiment, rib 70 extends chordwise between airfoil leading and trailing edges 48 and 50, respectively. Alternatively, rib 70 extends to only one of airfoil leading or trailing edges 48 and 50, respectively. In a further alternative embodiment, rib 70 extends only partially along side wall 46 between airfoil leading and trailing edges 48 and 50, respectively, and does not extend to either leading or trailing edges 48 and 50, respectively.

Rib 70 has a frusto-conical cross-sectional profile such that a root 74 of rib 70 has a radial height 76 that is taller than a radial height 78 of an outer edge 80 of rib 70. In the exemplary embodiment, both height 76 and height 78 are substantially constant along rib 70 between a first edge 84 and a second edge 86. In an alternative embodiment, at least one of root height 74 and outer edge height 78 is variable between rib edges 84 and 86. A geometric configuration of rib 70, including a relative position, size, and length of rib 70 with respect to blade 40, is variably selected based on operating and performance characteristics of blade 40.

Rib 70 also includes a radially outer side wall 90 and a radially inner side wall 92. Radially outer side wall 90 is between airfoil tip 54 and radially inner side wall 92, and radially inner side wall 92 is between radially outer side wall 90 and airfoil root 52. Each rib side wall 90 and 92 is contoured between rib root 74 and rib outer edge 80. In the exemplary embodiment, rib 70 is symmetrical about a plane of symmetry 94, such that rib side walls 90 and 92 are identical. In an alternative embodiment, side walls 90 and 92 are each different and are not identical.

Rib outer edge 80 extends a distance 100 from side wall 46 into the airflow, and rib plane of symmetry 94 is positioned a radial distance 102 from airfoil tip 54 towards airfoil root 52. Distances 100 and 102 are variably selected based on operating and performance characteristics of blade 40.

During operation, ribs 70 provide a restriction to communication of airflow between airfoil pressure and suction sides 44 and 46, respectively. More specifically, during operation as a gap (not shown) between airfoil tip 54 and a stationary shroud (not shown) is widened, the natural tendency is for higher pressure, pressure side airflow to flow towards airfoil tip 54. However, because rib 70 extends outwardly into the airflow, rib 70 directs air flowing towards airfoil tip 54 downstream in an intended direction and thus, inhibits tip spillage across tip 54, and facilitates increased compressor efficiency.

Furthermore, rib 70 also provides chordwise stiffness near airfoil tip 54. More specifically, rib 70 facilitates providing structural support to blade 40 such that chordwise bending modes of vibration that may be induced adjacent blade tip 54 are facilitated to be reduced through the geometric configuration of each rib 70. In addition, because rib 70 is positioned radial distance 102 from tip 54, rib 70 will not contact the stationary shroud.

Figure 4:
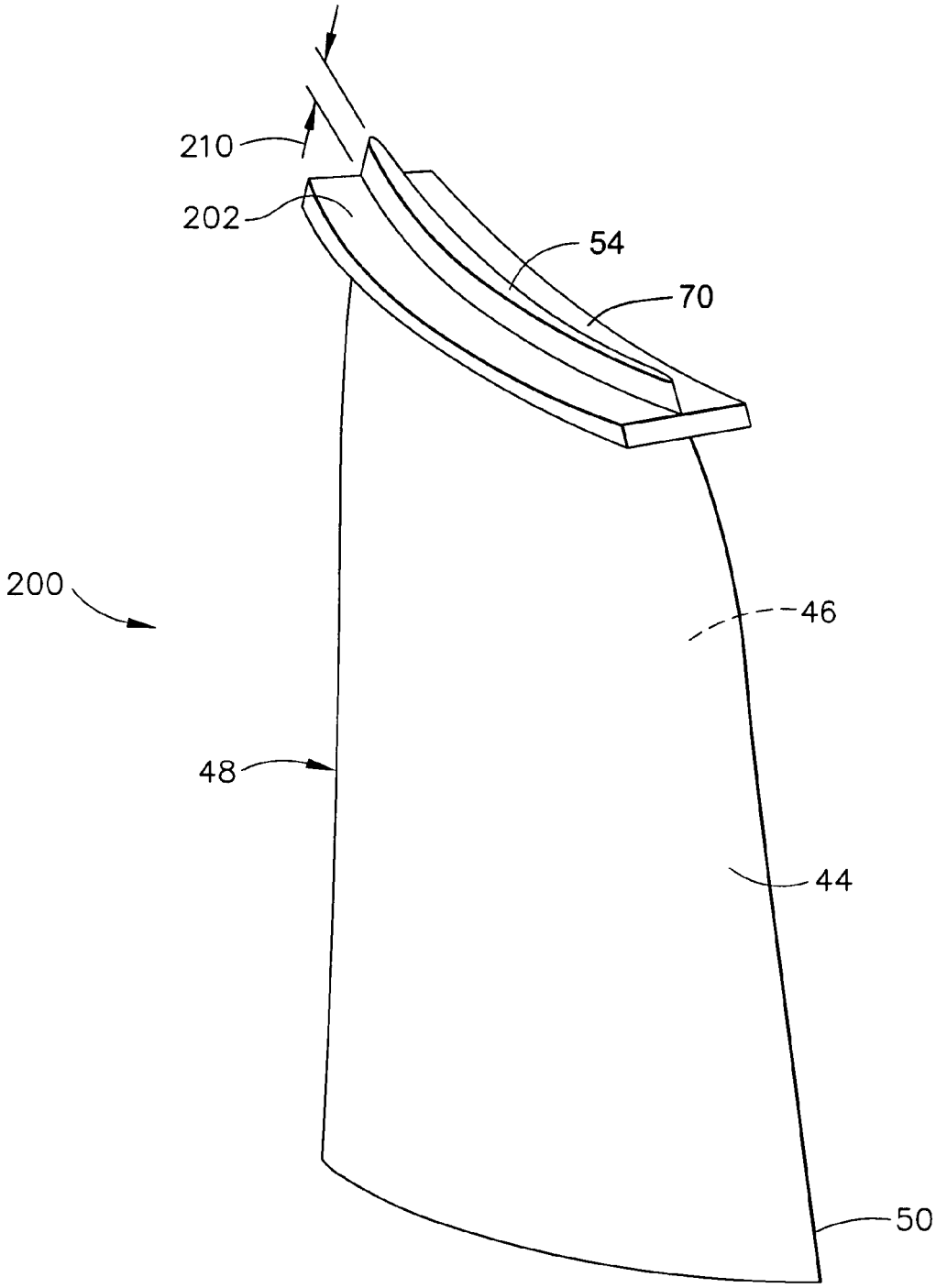
FIG. 4 is a perspective view of an alternative embodiment of a rotor blade that may be used with the gas turbine engine shown in FIG. 1.

FIG. 4 is a perspective view of an alternative embodiment of rotor blade 200 that may be used with the gas turbine engine 10 (shown in FIG. 1). Rotor blade 200 is substantially similar to rotor blade 40 (shown in FIGS. 2 and 3) and components in rotor blade 200 that are identical to components of rotor blade 40 are identified in FIG. 4 using the same reference numerals used in FIGS. 2 and 3. Specifically, in one embodiment, rotor blade 200 is identical to rotor blade 40 with the exception that rotor blade 200 includes a second rib 202 in addition to rib 70. More specifically, in the exemplary embodiment, rib 202 is identical to rib 70 but extends across side wall 44 rather than side wall 46.

Rib 202 extends outwardly from first side wall 44 and is contoured to conform to side wall 44, and as such, follows airflow streamlines extending across side wall 44. In the exemplary embodiment, rib 202 extends in a chordwise direction across side wall 44. Alternatively, rib 202 is aligned in a non-chordwise direction with respect to side wall 44. More specifically, in the exemplary embodiment, rib 202 extends chordwise between airfoil leading and trailing edges 48 and 50, respectively. Alternatively, rib 202 extends to only one of airfoil leading or trailing edges 48 and 50, respectively. In a further alternative embodiment, rib 202 extends only partially along side wall 44 between airfoil leading and trailing edges 48 and 50, respectively, and does not extend to either leading or trailing edges 48 and 50, respectively.

A geometric configuration of rib 202, including a relative position, size, and length of rib 202 with respect to blade 40, is variably selected based on operating and performance characteristics of blade 40. Rib 202 is positioned a radial distance 210 from airfoil tip 54. In the exemplary embodiment, radial distance 210 is approximately equal first rib radial distance 102 (shown in FIG. 3). In an alternative embodiment, radial distance 210 is not equal first rib radial distance 102.

The above-described rotor blade is cost-effective and highly reliable. The rotor blade includes a rib that extends outwardly from at least one of the airfoil side walls. The rib facilitates restricting communication of flow radially above and radially below the rib. As such, tip spillage is facilitated to be reduced, and compressor efficiency is facilitated to be improved. Furthermore, the rib facilitates providing additional structural support to the blade. As a result, a rib is provided that facilitates improved aerodynamic performance of a blade, while providing aeromechanical stability to the blade, in a cost effective and reliable manner.

Exemplary embodiments of blade assemblies are described above in detail. The blade assemblies are not limited to the specific embodiments described herein, but rather, components of each assembly may be utilized independently and separately from other components described herein. Each rotor blade component can also be used in combination with other rotor blade components.

While the invention has been described in terms of various specific embodiments, those skilled in the art will recognize that the invention can be practiced with modification within the spirit and scope of the claims.

What is claimed is:

1. A method for fabricating a rotor blade for a gas turbine engine, said method comprising:

forming an airfoil including a first side wall and a second side wall that each extend in radial span between an airfoil root and an airfoil tip, and wherein the first and second side walls are connected at a leading edge and at a trailing edge;

forming a first rib that extends from the trailing edge to the leading edge and extends a first distance outward from the airfoil first side wall, such that the first rib is positioned between the airfoil tip and the airfoil root at a first radial distance from the tip, and such that the first rib facilitates reducing airflow spillage from flowing from a pressure side of the airfoil to a suction side of the airfoil past the airfoil tip wherein the first distance is substantially uniform across the full length of the first rib, and wherein the first radial distance from the tip is substantially uniform across the full length of the first rib; and forming a second rib that extends from the trailing edge to the leading edge and extends outwardly a second distance from the airfoil second side wall, such that the second rib is positioned between the airfoil tip and the airfoil root at a second radial distance from the tip, wherein the second radial distance is approximately equal to the first radial distance and the second distance from the airfoil second side wall is substantially uniform across the full length of the second rib and the second distance is approximately equal to the first distance from the airfoil first side wall;

wherein the first rib comprises a leading end that is adjacent the leading edge and a trailing end that is adjacent to the trailing edge, and the second rib comprises a leading end that is adjacent the airfoil leading edge and a trailing end that is adjacent to the airfoil trailing edge.

2. A method in accordance with claim 1 wherein said forming a first rib and said forming a second rib comprises forming the first and second ribs such that the first and second ribs extend in a chordwise direction between the airfoil leading edge and the airfoil trailing edge.

3. A method in accordance with claim 1 wherein said forming a first rib comprises forming the first rib with a frusto-conical cross-sectional profile that facilitates providing structural support to the airfoil.

4. An airfoil for a gas turbine engine, said airfoil composing:

a leading edge;

a trailing edge;

a tip;

a first side wall extending in radial span between an airfoil root and said tip, said first side wall defining a first side of said airfoil;

a second side wall connected to said first side wall at said leading edge and said trailing edge, said second side wall extending in radial span between the airfoil root and said tip, said second side wall defining a second side of said airfoil;

a first rib extending outwardly a substantially uniform first distance from said first side wall and extending from said trailing edge to said leading edge, said first rib positioned radially between said tip and said airfoil root at a first radial distance, wherein said first rib comprises a leading end that is adjacent said airfoil leading edge and a trailing end that is adjacent to said airfoil trailing edge, said first radial distance is substantially uniform across a full length of said first rib, said first rib configured to reduce airflow spillage from flowing from a pressure side of the airfoil to a suction side of the airfoil past said tip; and a second rib extending outwardly a substantially uniform second distance from said second side wall and extending from said trailing edge to said leading edge, said second rib positioned radially between said airfoil tip and said airfoil root at a second radial distance, wherein said second rib comprises a leading end that is adjacent said airfoil leading edge and a trailing end that is adjacent to said airfoil trailing edge, and wherein said second radial distance is approximately equal to said first radial-distance.

5. An airfoil in accordance with claim 4 wherein one of said airfoil first side wall and said second side wall is concave, said remaining side wall is convex, and said first and second ribs extend chordwise between said airfoil leading and trailing edges.

6. An airfoil in accordance with claim 4 wherein said first rib is further configured to provide structural support to said airfoil.

7. An airfoil in accordance with claim 4 wherein said rib first comprises a base, an outer edge, and a body extending therebetween, said body is frusto-conical such that said base has a radial height that is larger than a height of said outer edge.

8. An airfoil in accordance with claim 4 wherein said first rib extends outwardly a first distance from said first side wall that is substantially uniform across the fill length of said first rib, wherein said second rib extends outwardly a second distance from said second side wall that is substantially uniform across the full length of said second rib, and wherein said first and second distances are approximately equal.

9. A gas turbine engine compfising a plurality of rotor blades, each said rotor blade compfising an airfoil compfising a leading edge, a trailing edge, a first side wall, a second side wall, and first and second ribs, said airfoil first and second side walls connected axially at said leading and trailing edges, said first and second side walls extending radially from an airfoil root to an airfoil tip, said first rib extending from said trailing edge to said leading edge and extending outwardly a first distance from said airfoil first side wall, wherein said first distance is substantially uniform across the full length of said first rib, said first rib positioned at a first radial distance between said airfoil root and said airfoil tip, said first radial distance is substantially uniform across the frill length of said first rib, said first side wall defining a pressure side of said airfoil, said second side wall defining a suction side of said airfoil, said first rib configured to facilitate reducing air flowing from said airfoil pressure side to said airfoil suction side past said airfoil tip, said second rib extending from said trailing edge to said leading edge and extending outwardly a second distance from said airfoil second side wall, wherein said second distance from the airfoil second side wall is substantially uniform across the full length of said second rib, said second rib positioned at a second radial distance between said airfoil root and said airfoil tip, wherein said second radial distance is approximately equal to said first radial distance and said first and second distances are approximately equal.

10. A gas turbine engine in accordance with claim 9 wherein one of said rotor blade airfoil first side wall and said second side wall is concave, said remaining side wall is convex, and said first and second ribs extend chordwise between said leading and trailing edges.

11. A gas turbine engine in accordance with claim 9 wherein said first rib comprises a frusto-conical cross-sectional profile.

12. A gas turbine engine in accordance with claim 9 wherein said first rib comprises a leading end that is adjacent said airfoil leading edge and a trailing end that is adjacent to said airfoil trailing edge, and said second rib comprises a leading end that is adjacent said airfoil leading edge and a trailing end that is adjacent to said airfoil trailing edge.

* * * * *